US007556211B2

(12) United States Patent
Duncan

(10) Patent No.: US 7,556,211 B2
(45) Date of Patent: Jul. 7, 2009

(54) INLET DUCT

(75) Inventor: Michael Duncan, Bordon (GB)

(73) Assignee: Earlex Limited, Guildford, Surrey (GB)

( * ) Notice: Subject to any disclaimer, the term of this patent is extended or adjusted under 35 U.S.C. 154(b) by 325 days.

(21) Appl. No.: 11/486,226

(22) Filed: Jul. 13, 2006

(65) Prior Publication Data

US 2007/0040049 A1 Feb. 22, 2007

(30) Foreign Application Priority Data

Aug. 18, 2005 (GB) ..... 0516908.1

(51) Int. Cl.
*B05B 1/28* (2006.01)

(52) U.S. Cl. ..... 239/290; 239/300; 239/525; 239/581.1; 239/DIG. 14

(58) Field of Classification Search ..... 239/290, 239/300, 301, 340, 407, 525, 569, 581.1, 239/590, 600, DIG. 14
See application file for complete search history.

(56) References Cited

U.S. PATENT DOCUMENTS 4,433,812 A * 2/1984 Grime ..... 239/290
4,531,675 A * 7/1985 Muck ..... 239/290
4,915,303 A * 4/1990 Hufgard ..... 239/300
5,881,955 A * 3/1999 Styne ..... 239/407
6,425,533 B1 * 7/2002 Shilton et al. ..... 239/290
6,708,900 B1 * 3/2004 Zhu et al. ..... 239/290

* cited by examiner

*Primary Examiner*—Steven J Ganey
(74) *Attorney, Agent, or Firm*—Lambert & Associates; Adam J. Bruno; Gary E. Lambert

(57) ABSTRACT

An HVLP paint sprayer having an inlet air duct equipped with a throttle to control air volume passing through the gun. The duct has a thick wall with a slot extending down from the top just past the bottom of the internal air passage. Close to its top, the slot has on opposite sides a pair of dimples directed towards each other. This is substantially the same size as the air passage and when aligned with it does not obstruct inlet duct air flow. The throttle is positioned by the dimples engaging in recesses and by a rim flange engaging on the outside of the duct. When less air is required, the throttle is pivoted about the dimples and recesses by pressing on the flange portion not abutting on the duct. Thus, the webbed portion of the throttle is brought to one side of the aperture, effectuating a throttle.

12 Claims, 3 Drawing Sheets

INLET DUCT

This application claims priority of United Kingdom Application No. 0516908.1, filed Aug. 18, 2005, the contents of which are hereby incorporated by reference into this application.

FIELD OF THE INVENTION

The present invention relates to an inlet duct for a paint sprayer.

BACKGROUND OF THE INVENTION

Paint sprayers, particularly of the high volume low pressure type, require a degree of adjustment of the air flow through the sprayer. This is not readily achieved by control of the blower, producing the air flow, since it usually employs a synchronous motor.

The object of the present invention is to provide means for controlling the air flow.

THE INVENTION

According to the invention there is provided an air inlet duct for an airflow paint sprayer, the inlet duct having:

a tubular wall and an internal bore, a transverse slot extending through the tubular wall and at least partially across the internal bore and a throttle pivotally arranged in the slot, the throttle having thickness to close the transverse slot against free escape of air from the duct and including a web to obstruct partially the bore in one pivotal position of the throttle and an opening to leave the bore at least substantially unobstructed in another pivotal position of the throttle.

Whilst it can be envisaged that the aperture may extend to a free edge of the throttle remote from its pivot, in the preferred embodiment, the aperture does not extend to the free edge. This allows the throttle to carry a respective seal on each side of the web sealing with sides of the transverse slot for closing it against free escape of air. For this the slot preferably extends partially into the wall of the duct remote from a pivot of the throttle.

The pivot can be provided externally of the duct. Again in the preferred embodiment, the pivot is provided in the form of dimples or recesses in the side of the slot, with the throttle being provided with complementary recesses or dimples.

Stop means is preferably provided to limit pivoting of the throttle in one direction to the fully open position and in the other direction to the partial obstruction position.

THE DRAWINGS

To help understanding of the invention, a specific embodiment thereof will now be described by way of example and with reference to the accompanying drawings, in which.

THE PREFERRED EMBODIMENT OF THE INVENTION

Figure 1:
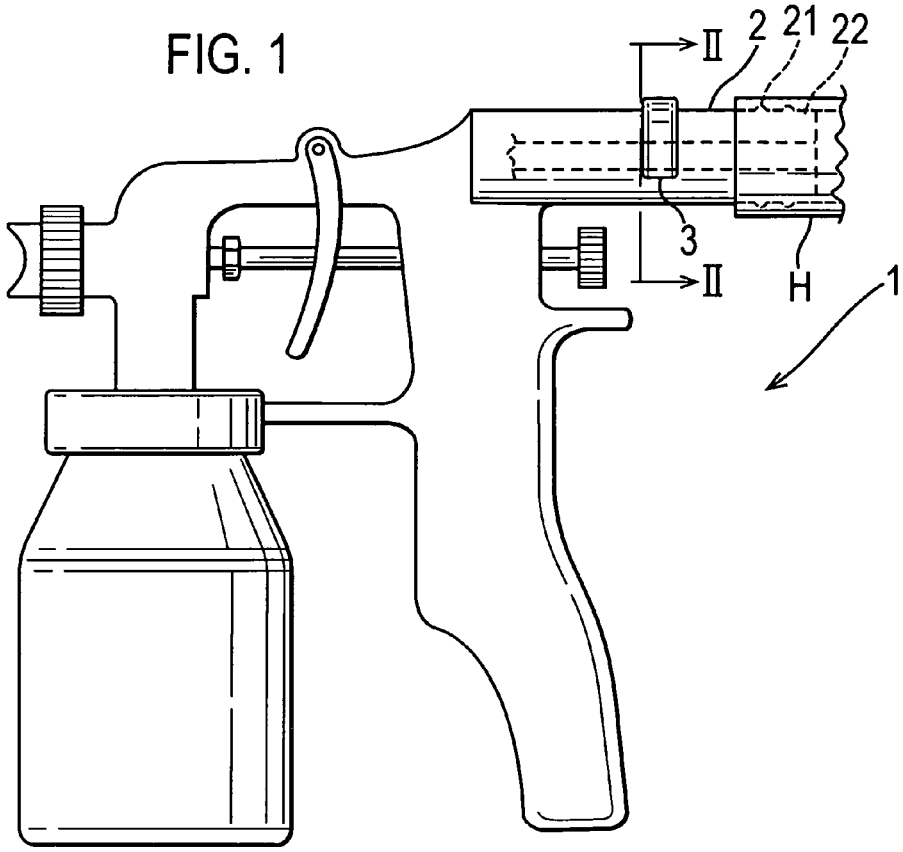
FIG. 1 is a side view of a painter sprayer of the invention.

Referring to the drawings, a paint sprayer 1, designed to be operated by a high volume low pressure air flow, has an inlet air duct 2. This is equipped with a throttle 3 to control the volume of air passing through the gun, certain paints requiring a greater air flow for their application than others.

The duct has a relatively thick wall 4, with a slot 5 extending down from the top just past the bottom of the internal air passage 6. Close to its top, the slot has on opposite sides a pair of dimples 7, directed towards each other.

Figure 2:
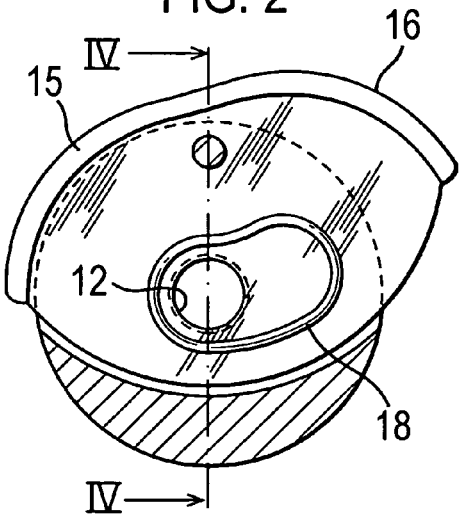
FIG. 2 is a transverse cross-sectional view on the line II-II in FIG. 1 of the air duct of the paint sprayer with the throttle fully open.

The throttle is essentially a plate 11, with an aperture 12. This is substantially the same size as the air passage 6 and when aligned with it does not obstruct the air flow in the inlet duct. This is the situation shown in FIG. 2. The throttle is located in position by means of the dimples engaging in recesses 14 in the sides of the plate and by a rim flange 15 engaging on the outside of the air duct.

Figure 3:
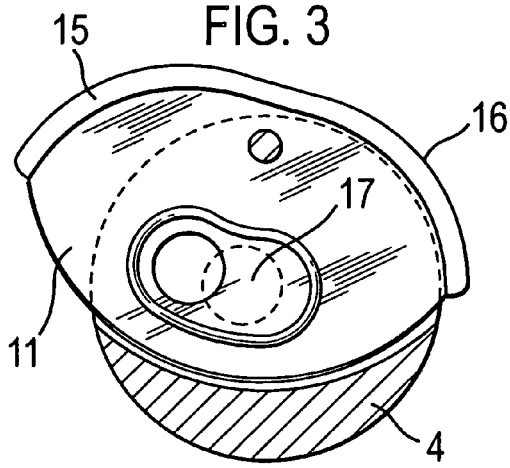
FIG. 3 is a view similar to FIG. 2, with the throttle partially obscuring the air inlet to the sprayer.
Figure 4:
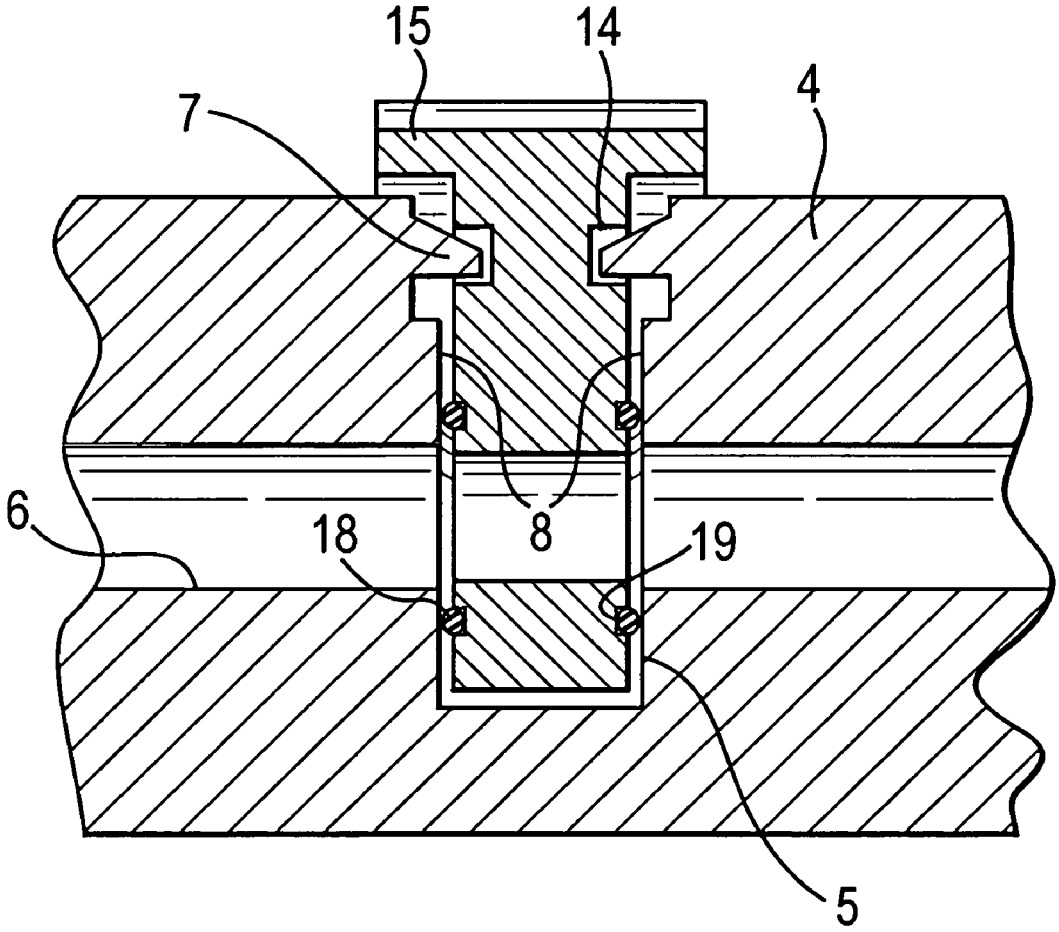
FIG. 4 is a lateral cross-sectional view on the line IV-IV in FIG. 2 showing a portion of inlet duct.

When less air is required, the throttle is pivoted about the dimples and recesses by pressing on the portion 16 of the flange 15 not abutting on the duct. This brings web part 17 of the throttle plate to one side of the aperture 12 into position partially across the duct, throttling it. This is the situation shown in FIG. 3. It will be appreciated that the throttle can be readily pivoted back to the fully open position or indeed an intermediate position.

To avoid air leakage from the duct at the throttle, it is provided with seals 18, set in grooves 19 in its opposite faces and encircling the aperture 12. It is in order for the seals to engage faces 8 of the slot all round the internal passage 6, that the slot extends just below the internal passage 6.

Figure 5:
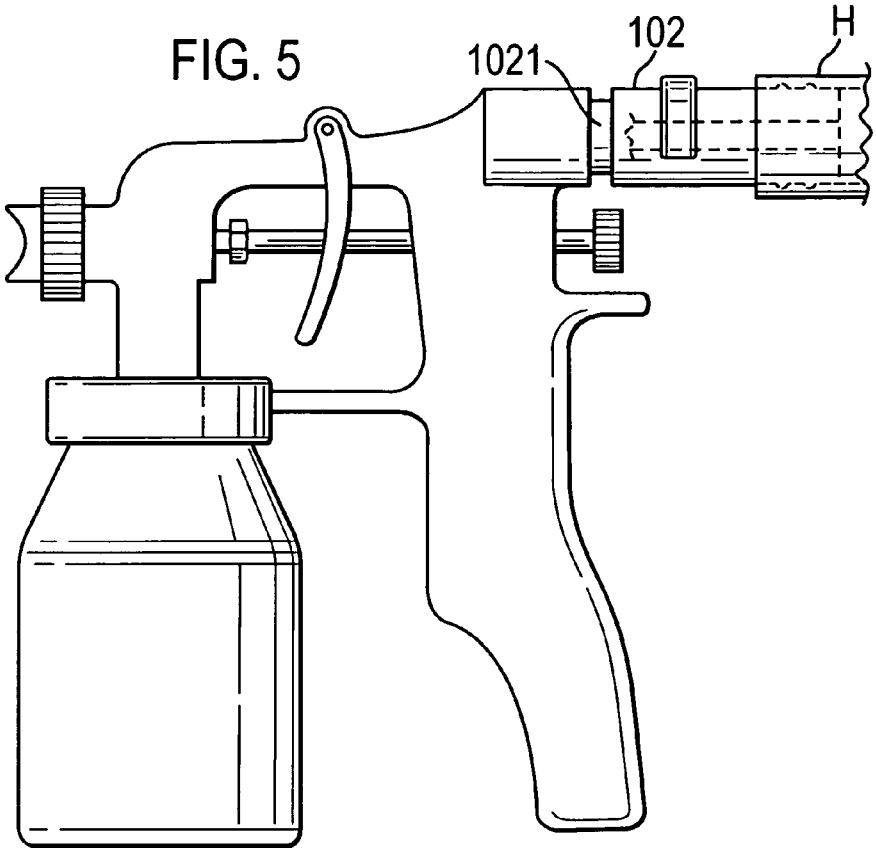
FIG. 5 is a side view of paint sprayer having a varied connection to its air supply hose.
Figure 6:
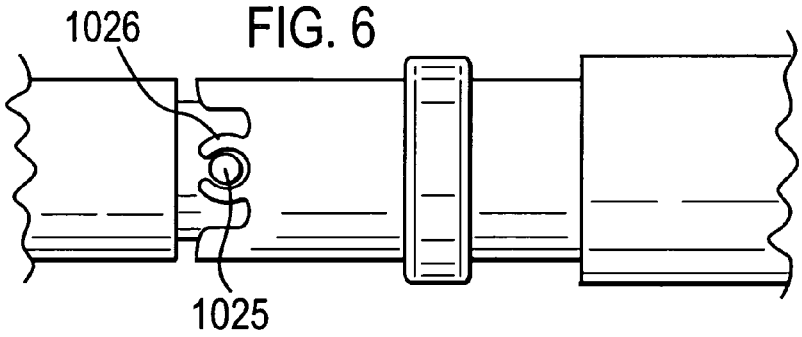
FIG. 6 is a scrap plan view of the connection.
Figure 7:
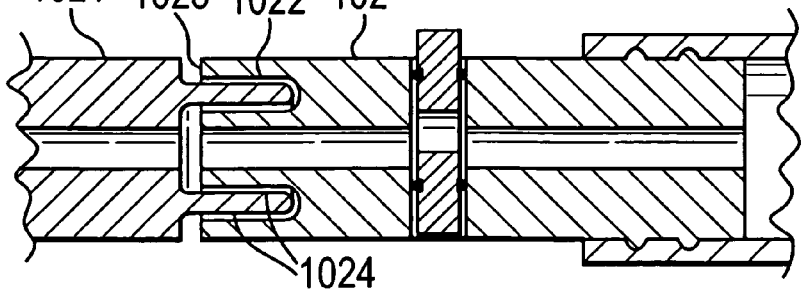
FIG. 7 is a scrap, cross-sectional view through the connection.

The invention is not intended to be restricted to the details of the above described embodiment. For instance, the throttle may be arranged in an end section of an air duct connectable to a disposable paint sprayer. FIG. 1 shows a hose H connected to the ribbed 21 remote end 22 of the inlet duct 2. In FIGS. 5, 6 and 7, the inlet duct 102 is separate from a connector 1021 integral with the sprayer. The duct has an annular groove 1022 in an end face 1023 and the connector has outer and inner surfaces 1024, the groove and the surfaces being a complementary push fit with each other. The connector is provided with a peg 1025 and the duct is provided with a pair of resilient fingers 1026 shaped to engage with the peg and hold the duct in position on the connector. The hose H connected to the duct 102 in like manner to the duct 2.

I claim:

1. An air inlet duct for an airflow paint sprayer, the air inlet duct having:

a tubular wall and an internal bore, a transverse slot extending through the tubular wall and at least partially across the internal bore and a throttle pivotally arranged in the transverse slot, the throttle having thickness to close the transverse slot against free escape of air from the air inlet duct and including a web to obstruct partially the internal bore in one pivotal position of the throttle and an opening in the web to leave the internal bore at least substantially unobstructed in another pivotal position of the throttle.

2. An air inlet duct according to claim 1, wherein the opening is a slot in the web extending to a free edge of the throttle remote from its pivot.

3. An air inlet duct according to claim 1, wherein the opening is an aperture in the web, the aperture being peripherally bounded by the web.

4. An air inlet duct according to claim 3, wherein the throttle carries a respective seal on each side of the web sealing with sides of the transverse slot for closing it against free escape of air.

5. An air inlet duct according to claim 3, wherein the transverse slot extends partially into the wall of the air inlet duct remote from a pivot of the throttle.

6. An air inlet duct according to claim 5, wherein the pivot is provided externally of the duct.

7. An air inlet duct according to claim 3, wherein the pivot is provided in the form of dimples or recesses in the side of the transverse slot, with the throttle being provided with complementary recesses or dimples.

8. An air inlet duct according to claim 1, including stop means for limiting pivoting of the throttle in one direction to the fully open position and in the other direction to the partial obstruction position.

9. An air inlet duct according to claim 1, wherein the duct is adapted for removable connection with a connector of a paint sprayer and for fixed connection to an air supply hose.

10. An air inlet duct according to claim 9, wherein the duct has an annular groove in an end face and the connector has outer and inner surfaces, the annular groove and the outer and inner surfaces capable of being a complementary push fit with each other.

11. An air inlet duct according to claim 9, wherein the connector is provided with a peg and the air inlet duct is provided with a pair of resilient fingers shaped to be capable of engaging with the peg and hold the air inlet duct in position on the connector.

12. A paint sprayer including an air inlet duct having:

a tubular wall and an internal bore, a transverse slot extending through the tubular wall and at least partially across the internal bore and a throttle pivotally arranged in the transverse slot, the throttle having thickness to close the transverse slot against free escape of air from the air inlet duct and including a web to obstruct partially the bore in one pivotal position of the throttle and an opening in the web to leave the internal bore at least substantially unobstructed in another pivotal position of the throttle, the air inlet duct being an integral part of the paint sprayer and adapted for connection with an air supply hose.

* * * * *